US007854034B2

(12) United States Patent
Welsh

(10) Patent No.: US 7,854,034 B2
(45) **Date of Patent: *Dec. 21, 2010**

(54) BRUSH

(76) Inventor: John L. Welsh, 2000 Duke St. Suite 100, Alexandria, VA (US) 22314

( * ) Notice: Subject to any disclaimer, the term of this patent is extended or adjusted under 35 U.S.C. 154(b) by 0 days.

This patent is subject to a terminal disclaimer.

(21) Appl. No.: 12/471,514

(22) Filed: May 26, 2009

(65) Prior Publication Data

US 2009/0288263 A1 Nov. 26, 2009

Related U.S. Application Data

(63) Continuation of application No. 11/878,053, filed on Jul. 20, 2007, now Pat. No. 7,552,498.

(51) Int. Cl.
*A46B 5/00* (2006.01)
*B25G 1/00* (2006.01)

(52) U.S. Cl. ..... 15/143.1; 15/159.1; 15/246; 16/110.1; 16/436; 248/110; 248/682; D4/130; D4/134; D4/138

(58) Field of Classification Search ..... 15/143.1, 15/159.1, 160, 164, 246; 16/110.1, 430, 16/436; 248/110, 682, 684, 280.11, 292.11; 401/131; D4/130, 132, 134, 138
See application file for complete search history.

(56) References Cited

U.S. PATENT DOCUMENTS

| | | | | |
|---|---|---|---|---|
| D120,843 | S | 5/1940 | Weber | |
| D138,640 | S | 8/1944 | Baker | |
| 4,502,176 | A | 3/1985 | Wallace | |
| 5,087,014 | A | 2/1992 | Desjardin | |
| D364,506 | S | 11/1995 | Cousins | |
| 5,577,289 | A | 11/1996 | Russell | |
| 5,769,383 | A | 6/1998 | Hemler | |
| 5,920,941 | A * | 7/1999 | Iannotta | 15/106 |
| D505,269 | S | 5/2005 | Cheung | |
| 2003/0000037 | A1 | 1/2003 | Carr et al. | |

FOREIGN PATENT DOCUMENTS

| | | |
|---|---|---|
| DE | 4331222 | 8/1994 |
| DE | 19609964 | 9/1997 |

* cited by examiner

*Primary Examiner*—Mark Spisich
(74) *Attorney, Agent, or Firm*—Welsh Flaxman & Gitler LLC

(57) ABSTRACT

A brush includes a head section having a scrubbing area and a handle section coupled to and extending from the head section. The handle section includes a proximal segment, a distal segment coupled to the head section, and a recess segment positioned between the proximal segment and the distal segment. The recess segment includes a recess having a first sidewall and an opposite second sidewall. The recess includes a center point between the first sidewall and the second sidewall. The proximal segment extends from a free end of the handle section to the center point and the distal segment extends from the center point to the head section. The weight of the proximal segment of the handle section balances the combined weight of the distal segment of the handle section and head section when the recess is placed on a dividing wall of a double sink.

11 Claims, 2 Drawing Sheets

BRUSH

CROSS REFERENCE TO RELATED APPLICATIONS

This application is a continuation of U.S. patent application Ser. No. 11/878,053, filed Jul. 20, 2007, entitled "Brush", now U.S. Pat. No. 7,552,498.

BACKGROUND OF THE INVENTION

1. Field of the Invention

The invention relates to brushes. More particularly, the invention relates to a brush having a handle shaped and dimensioned for resting upon the dividing wall of a double sink, most commonly a kitchen double sink.

2. Description of the Prior Art

Numerous brushes exist for use in the kitchen sink environment when dishware, cookware and utensils are being cleaned. These brushes generally include a bristle section, which is most often in contact with a sink or countertop surface when not in use. This contact promotes bacterial grow on the bristles which is then transferred to the object the brush is used to clean. The desire to avoid contact of the bristles with a surface when not in use is what led to the development of the present invention.

SUMMARY OF THE INVENTION

It is, therefore, an object of the present invention to provide a brush including a head section having a scrubbing area and a handle section coupled to and extending from the head section. The handle section includes a proximal segment, a distal segment coupled to the head section, and a recess segment positioned between the proximal segment and the distal segment. The recess segment includes a recess having a first sidewall and an opposite second sidewall. The recess includes a center point between the first sidewall and the second sidewall. The proximal segment extends from a free end of the handle section to the center point and the distal segment extends from the center point to the head section. The weight of the proximal segment of the handle section balances the combined weight of the distal segment of the handle section and head section when the recess is placed on a dividing wall of a double sink.

It is also an object of the present invention to provide a brush wherein the proximal segment further includes a weight attached adjacent the free end of the proximal segment.

It is also another object of the present invention to provide a brush wherein the recess includes sidewalls which taper inwardly as they extend from an outer surface of the handle.

It is also a further object of the present invention to provide a brush wherein the recess includes a flat base wall positioned between the first sidewall and the second sidewall.

It is another object of the present invention to provide a brush wherein the first sidewall and the second sidewall are covered with a resilient gripping material.

It is still another object of the present invention to provide a brush wherein the recess is covered with a resilient gripping material.

It is yet another object of the present invention to provide a brush wherein the scrubbing area includes bristles.

It is a further object of the present invention to provide a brush wherein the weight of the proximal segment of the handle section is equal to or slightly greater than the combined weight of the distal segment of the handle section and head section when the recess is placed on a dividing wall of a double sink.

Other objects and advantages of the present invention will become apparent from the following detailed description when viewed in conjunction with the accompanying drawings, which set forth certain embodiments of the invention.

DESCRIPTION OF THE PREFERRED EMBODIMENT

Figure 1:
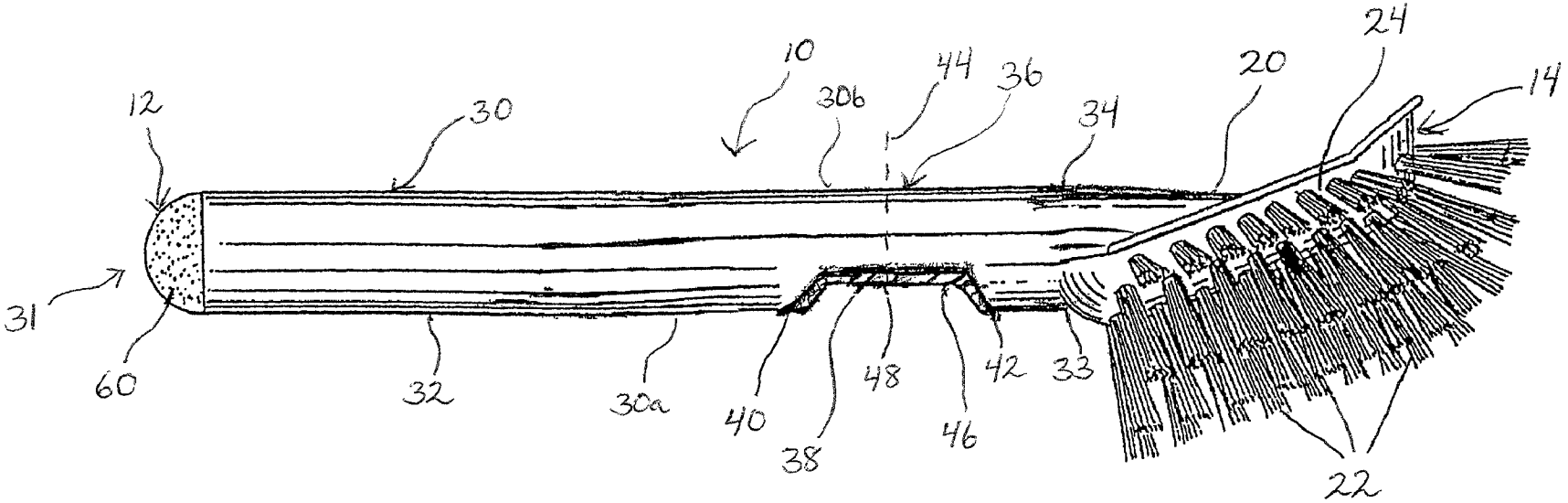
FIG. 1 is a side perspective view showing the brush of the present invention.
Figure 2:
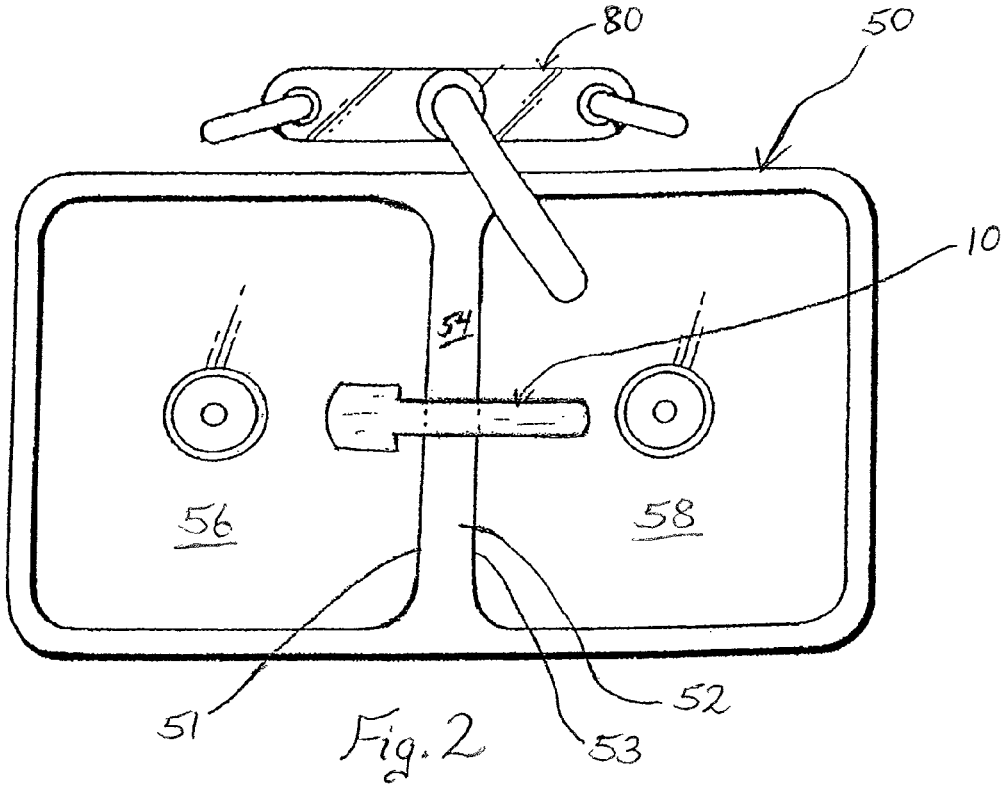
FIG. 2 is a top view showing the brush balanced on the dividing wall of a double sink.
Figure 3:
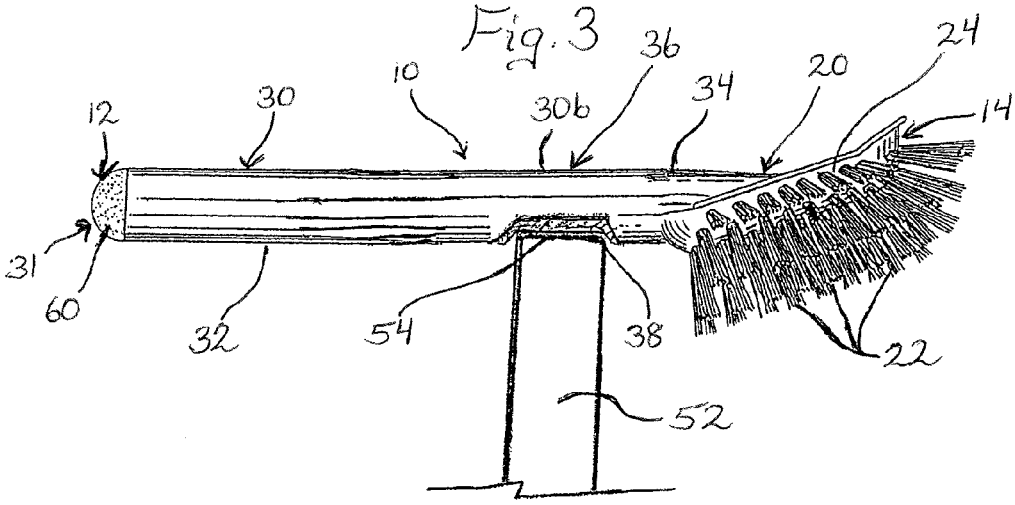
FIG. 3 is a side view showing the brush balanced on the dividing wall of a double sink.

The detailed embodiment of the present invention is disclosed herein. It should be understood, however, that the disclosed embodiment is merely exemplary of the invention, which may be embodied in various forms. Therefore, the details disclosed herein are not to be interpreted as limiting, but merely as the basis for the claims and as a basis for teaching one skilled in the art how to make and/or use the invention.

With reference to the various figures, a brush 10 in accordance with the present invention is disclosed. The brush 10 includes a head section 20 and a handle section 30 coupled to and extending from the head section 20. The handle section 30 includes a free first end 31 and a second end 33 connected directly to the head section 20. The handle section 30 includes a proximal segment 32, a distal segment 34 coupled to the head section 20, and a recess segment 36 positioned between the proximal segment 32 and the distal segment 34. The recess segment 36 includes a recess 38 having a first sidewall 40 and an opposite second sidewall 42, the recess 38 including a center point 44 between the first sidewall 40 and the second sidewall 42. The proximal segment 32 extends from a free end 31 of the handle section 30 to the center point 44 and the distal segment 34 extends from the center point 44 to the second end 33 of the handle section 30 where it connects with the head section 20. The weight of the proximal segment 32 of the handle section 30 balances the combined weight of the distal segment 34 of the handle section 30 and head section 20 when the recess 38 is placed on a dividing wall 52 of a double sink 50. In accordance with a preferred embodiment, the weight of the proximal segment 32 of the handle section 30 is equal to or slightly greater than the combined weight of the distal segment 34 of the handle section 30 and head section 20 such that when the recess 38 is placed on a dividing wall 52 of a double sink 50 a head section 20 the brush remains balanced thereon. As a result, the present brush 10 is shaped and dimensioned for sitting upon the dividing wall 52 of a double sink 50, most commonly a kitchen double sink, in a manner securely and conveniently supporting the brush 10 above the sink bowls 56, 58.

As most homeowners will appreciate, a double sink 50 includes a pair of sink bowls 56, 58. The sink bowls 56, 58 are separated by a dividing wall 52 positioned between the respective left sink bowl 56 and the right sink bowl 58. In most instances, the left sink bowl and the right sink bowl are substantially similar in shape and size. However, a wide variety of designs are available wherein the sink bowls may be of different sizes and shapes. The present invention applies to any of these designs so long as a dividing wall is provided between the adjacent sink bowls.

As briefly discussed above, and in accordance with the present invention, the brush 10 includes a head section 20 having a scrubbing area 24 having bristles 22 extend therefrom on a first side of the brush and a handle section 30 composed of proximal segment 32 and a distal segment 34, wherein the distal segment 34 is connected to the head section 20. A recess segment 36 connects the proximal segment 32 to the distal segment 34. The recess segment 36 includes a recess 38 positioned on the first side of the brush having a first sidewall 40 and an opposite second sidewall 42. The recess 38 includes a center point 44 between the first sidewall 40 and the second sidewall 42, more particularly, equidistant from the first sidewall 40 and the second sidewall 42. The proximal segment 32 extends from a free end 31 of the handle section 30 to the center point 44 and the distal segment 34 extends from the center point 44 to the head section 20. The recess 38 is located at a position wherein the weight of the handle section 30 on one side of the recess 38 balances the combined weight of the handle section 30 and the head section 20 on the opposite side of the recess 38. In order to achieve this balance, the weight of the proximal segment 32 of the handle section 30 is equal to or slightly greater than the combined weight of the distal segment 34 of the handle section 30 and the head section 20 on the opposite side of the center point 44 of the recess 38 such that when the recess 38 of the brush 10 is placed in contact with the dividing wall 52 of a double sink 50 the brush 10 remains balanced thereon.

A weight member 60 shown attached to the free end 31 of handle section 30 is provided to achieve this weighting. However, and as those skilled in the art will certainly appreciate, the weight may need to be located in the head section depending upon the relative weight between the handle section and head section opposite the recess or no weight member may be needed at all.

In accordance with a preferred embodiment, the head section 20 includes a plurality of outwardly extending bristles 22 extending from a scrubbing area 24 in the form of a support plate. The bristles 22 are designed for engaging and dislodging dirt from dishware and cookware, including, but not limited to, bowls, plates, pans, pots and other kitchen utensils.

The handle section 30 is a substantially elongated member and may be manufactured from a variety of materials. In accordance with a preferred embodiment, the handle section 30 is made from injection molded plastic while the bristles 22 are made from nylon. Although a nylon bristle brush and a plastic handle are disclosed in accordance with the preferred embodiment, the brush head and handle section may take a variety of forms known to those skilled in the art without departing from the spirit of the present invention. In addition, although a bristle head section is disclosed in accordance with a preferred embodiment, those skilled in the art will appreciate other head structures, for sponge-type heads, may be used without departing from the spirit of the present invention.

The handle section 30 includes a recess segment 36 located between the first end 12 and the second end 14 of the brush 10. As briefly mentioned above, the recess segment 36 includes a recess 38 shaped and dimensioned to receive the dividing wall 52 of the double sink 50 such that the brush 10 is supported in a convenient and secure manner from the dividing wall 52 while the bristles 22 and handle section 30 are suspended above the surface of the left and right sink bowls 56, 58.

With this in mind, the recess 38 has a trapezoidal configuration. The opening of the recess 38 at its outermost edges is larger than the opening of a recess 38 at the interior portion thereof. In particular, the recess 38 is defined by a first sidewall 40 and a second sidewalls 42 respectively, and a connecting base wall 48 extending between the first sidewall 40 and the second sidewalls 42. The first sidewall 40 and second sidewall 42 are tapered inwardly as they extend from the outer surface 30*a* on the first side toward the outer opposite surface 30*b* on the second opposite side of the handle section 30 in the center thereof. In this way, a trapezoidal recess 38 is constructed. Generally, the shape is such that when viewed from the side the first sidewall 40 and the second sidewalls 42 taper inwardly and intersect the flat base wall 48.

The trapezoidal recess 38 is designed so as to allow the brush 10 to be supported on dividing walls 52 of various thicknesses by allowing different points on the tapered first and second sidewalls 40, 42 of the recess 38 to engage the upper edges 51, 53 of the dividing wall 52 depending upon the dividing wall's thickness. In particular, and as those skilled in the art will appreciate, the inwardly tapering recess 38 allows the first sidewall 40 and second sidewall 42 to engage a dividing wall 52 of a double sink 50 having a thickness which extends between the larger exterior opening of the recess 38 at the outermost edges on the outer surface 30*a* of handle section 30 thereof and the smaller interior opening created as the recess 38 extends toward the center of the handle section 30.

Improved support of the brush 10 upon the dividing wall 52 is achieved by ensuring the sections of the brush 10 opposite the central recess 38 are substantially identical in weight. Slightly greater weighting on the proximal segment 32 side of the recess 38 has been found to cause the head section 20 to be angled upward as the brush 10 is supported on the dividing wall 52, thus exposing the bristles 22 to more air flow and quicker drying. As such, the brush 10 will substantially balance upon the dividing wall 52 while the inwardly tapered recess 38 engages and securely holds the brush 10 upon the dividing wall 52.

Enhanced attachment of the recess 38 upon the dividing wall 52 is achieved by coating the exposed surface of the recess 38 with a resilient gripping material 46. The resilient gripping material 46 is generally comprised of an elastomer. The resilient gripping material 46 will engage the upper surface 54 and upper edges 51, 53 of the dividing wall 52 and frictionally hold the brush 10 upon the dividing wall 52 with a higher coefficient of friction than the material of the handle section 30 itself. Although it is further contemplated that the entire handle could be made from a resilient elastomer material.

The desire to support the brush 10 on the dividing wall 52 is for sanitary reasons. The brush 10 will be supported above the left and right sink bowls 56, 58 and thus is allowed to drip therein as it dries between uses. This is in contrast to laying the brush on the kitchen countertop and dripping thereon while resting in the water dripped thereon or lying in the sink bowl and becoming further contaminated. The further contamination may be by other materials being poured into the sink or resting upon an unclean sink bowl surface 56, 58 which repeatedly gets wet every time the faucet is turned on.

While the preferred embodiments have been shown and described, it will be understood that there is no intent to limit the invention by such disclosure, but rather, is intended to cover all modifications and alternate constructions falling within the spirit and scope of the invention.

The invention claimed is:

1. A brush, comprising:

a head section having a scrubbing area on a first side of the brush including bristles extending from the first side of the brush;

a handle section coupled to and extending from the head section, the handle section including a proximal segment, a distal segment coupled to the head section, and a recess segment positioned between the proximal segment and the distal segment, the recess segment including a recess positioned on the first side having a first sidewall and an opposite second sidewall, the recess including a center point between the first sidewall and the second sidewall and the proximal segment extends from a free end of the handle section to the center point and the distal segment extends from the center point to the head section, the recess includes a resilient gripping material;

wherein the weight of the proximal segment of the handle section balances the combined weight of the distal segment of the handle section and head section when the recess is placed on a dividing wall of a double sink.

2. The brush according to claim 1, wherein the proximal segment further includes a weight attached adjacent the free end of the proximal segment.

3. The brush according to claim 1, wherein the recess includes side walls which taper inwardly as they extend from an outer surface of the handle.

4. The brush according to claim 3, wherein the recess includes a flat base wall positioned between the first sidewall and the second sidewall.

5. The brush according to claim 3, wherein the first sidewall and the second sidewall are covered with a resilient gripping material.

6. A brush, according to claim 1, wherein the proximal segment is weighted greater than the distal segment of the handle section and head section.

7. A brush, comprising:

a head section having a scrubbing area on a first side of the brush;

a handle section coupled to and extending from the head section, the handle section including a proximal segment, a distal segment coupled to the head section, and a recess segment positioned between the proximal segment and the distal segment, the recess segment including a recess positioned on the first side having a first sidewall and an opposite second sidewall, the recess including a center point between the first sidewall and the second sidewall and the proximal segment extends from a free end of the handle section to the center point and the distal segment extends from the center point to the head section;

wherein the weight of the proximal segment of the handle section is slightly greater than the combined weight of the distal segment of the handle section and head section when the recess is placed on a dividing wall of a double sink; and wherein the recess includes side walls which taper inwardly as they extend from an outer surface of the handle.

8. The brush according to claim 7, wherein the recess includes a flat base wall positioned between the first sidewall and the second sidewall.

9. The brush according to claim 7, wherein the first sidewall and the second sidewall are covered with a resilient gripping material.

10. The brush according to claim 7, wherein the recess is covered with a resilient gripping material.

11. The brush according to claim 7, wherein the scrubbing area includes bristles.

* * * * *